US006705612B1

(12) United States Patent
Fousteris

(10) Patent No.: US 6,705,612 B1
(45) Date of Patent: Mar. 16, 2004

(54) CARD GAME SYSTEM AND METHOD OF PLAYING A CARD GAME

(76) Inventor: Marc J. Fousteris, 2061 Keystone Dr., Apt. D, Jupiter, FL (US) 33458

( * ) Notice: Subject to any disclaimer, the term of this patent is extended or adjusted under 35 U.S.C. 154(b) by 0 days.

(21) Appl. No.: 10/122,908

(22) Filed: Apr. 12, 2002

(51) Int. Cl.[7] ..... A63F 1/00
(52) U.S. Cl. ..... 273/274; 273/292
(58) Field of Search ..... 273/274, 309, 273/292; 463/12, 13

(56) References Cited

U.S. PATENT DOCUMENTS 4,836,553 A * 6/1989 Suttle et al. ..... 273/292
5,566,946 A * 10/1996 Parker ..... 273/292
5,829,750 A * 11/1998 Booker ..... 273/292
5,836,586 A 11/1998 Marks et al.
5,997,002 A * 12/1999 Goldman ..... 273/292
6,000,699 A * 12/1999 Long ..... 273/292
6,012,719 A 1/2000 Webb
6,095,525 A 8/2000 Terminel
6,102,402 A * 8/2000 Scott et al. ..... 273/292
6,113,102 A 9/2000 Marks et al.
6,158,741 A 12/2000 Koelling
6,164,652 A 12/2000 Lauretta et al.
6,206,375 B1 * 3/2001 Wichinsky ..... 273/292
6,257,580 B1 * 7/2001 Brown ..... 273/274
6,345,824 B1 * 2/2002 Selitzky ..... 273/292
6,375,188 B1 * 4/2002 Painter et al. ..... 273/292
6,446,971 B1 * 9/2002 Baranauskas ..... 273/292
6,454,266 B1 * 9/2002 Breeding et al. ..... 273/292
6,481,718 B2 * 11/2002 Koelling ..... 273/292
6,485,020 B1 * 11/2002 Broadnax ..... 273/292
6,511,070 B1 * 1/2003 Daines ..... 273/292

* cited by examiner

*Primary Examiner*—William M. Pierce

(57) ABSTRACT

A card game system and method of playing a card game for providing entertainment through a game of chance. The card game system and method of playing a card game includes a plurality of decks. Each of the decks comprises a plurality of suits. Each of the suits has a plurality of cards. A playing member has an upper surface. The playing member has a plurality of playing indicia on the upper surface. The playing indicia comprises a plurality of player indicia and a dealer area. Each of the player indicia are adapted for indicating a position of a player when a dealer deals the cards. The dealer area indicates the cards dealt to the dealer.

23 Claims, 3 Drawing Sheets

| | | |
|---|---|---|
| GRAND FLUSH | (777'S SUITED | PAYS 1,000 TO 1 |
| GRAND ROYAL | (3 OF A KIND SUITED) | PAYS 500 TO 1 |
| EXCALIBUR | (3 777'S) | PAYS 100 TO 1 |
| LADY OF THE LAKE | (3 OF A KIND) | PAYS 50 TO 1 |
| 3 HEADED MONSTER | (3 TEN'S) | PAYS 8 TO 1 |
| GRAND MAJESTY | (3 CARDS=TO POINT) | PAYS 5 TO 1 |
| GRAND MAJESTY | (WITHOUT $1 SIDE WAGER) | PAYS 2 TO 1 |

CARD GAME SYSTEM AND METHOD OF PLAYING A CARD GAME

BACKGROUND OF THE INVENTION

1. Field of the Invention

The present invention relates to card games and more particularly pertains to a new card game system and method of playing a card game for providing entertainment through a game of chance.

2. Description of the Prior Art

The use of card games is known in the prior art. More specifically, card games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,164,652; U.S. Pat. No. 6,158,741; U.S. Pat. No. 6,113,102; U.S. Pat. No. 6,095,525; U.S. Pat. No. 6,012,719; and U.S. Pat. No. 5,836,586.

While these devices fulfill their respective, particular objectives and requirements, the aforementioned patents do not disclose a new card game system and method of playing a card game. The inventive device includes a plurality of decks. Each of the decks comprises a plurality of suits. Each of the suits has a plurality of cards. A playing member has an upper surface. The playing member has a plurality of playing indicia on the tipper surface. The playing indicia comprises a plurality of player indicia and a dealer area. Each of the player indicia are adapted for indicating a position of a player when a dealer deals the cards. The dealer area indicates the cards dealt to the dealer.

In these respects, the card game system and method of playing a card game according to the present invention substantially departs from the conventional concepts and designs of the prior art, and in so doing provides an apparatus primarily developed for the purpose of providing entertainment through a game of chance.

SUMMARY OF THE INVENTION

In view of the foregoing disadvantages inherent in the known types of card games now present in the prior art, the present invention provides a new card game system and method of playing a card game construction wherein the same can be utilized for providing entertainment through a game of chance.

The general purpose of the present invention, which will be described subsequently in greater detail, is to provide a new card game system and method of playing a card game apparatus and method which has many of the advantages of the card games mentioned heretofore and many novel features that result in a new card game system and method of playing a card game which is not anticipated, rendered obvious, suggested, or even implied by any of the prior art card games, either alone or in any combination thereof.

To attain this, the present invention generally comprises a plurality of decks. Each of the decks comprises a plurality of suits. Each of the suits has a plurality of cards. A playing member has an upper surface. The playing member has a plurality of playing indicia on the upper surface. The playing indicia comprises a plurality of player indicia and a dealer area. Each of the player indicia are adapted for indicating a position of a player when a dealer deals the cards. The dealer area indicates the cards dealt to the dealer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new card game system and method of playing a card game apparatus and method which has many of the advantages of the card games mentioned heretofore and many novel features that result in a new card game system and method of playing a card game which is not anticipated, rendered obvious, suggested, or even implied by any of the prior art card games, either alone or in any combination thereof.

It is another object of the present invention to provide a new card game system and method of playing a card game which may be easily and efficiently manufactured and marketed.

It is a further object of the present invention to provide a new card game system and method of playing a card game which is of a durable and reliable construction.

An even further object of the present invention is to provide a new card game system and method of playing a card game which is susceptible of a low cost of manufacture with regard to both materials and labor, and which accordingly is then susceptible of low prices of sale to the consuming public, thereby making such card game system and method of playing a card game economically available to the buying public.

Still yet another object of the present invention is to provide a new card game system and method of playing a card game which provides in the apparatuses and methods of the prior art some of the advantages thereof, while simultaneously overcoming some of the disadvantages normally associated therewith.

Still another object of the present invention is to provide a new card game system and method of playing a card game for providing entertainment through a game of chance.

Yet another object of the present invention is to provide a new card game system and method of playing a card game which includes a plurality of decks. Each of the decks comprises a plurality of suits. Each of the suits has a plurality of cards. A playing member has an upper Surface. The playing member has a plurality of playing indicia on the upper surface. The playing indicia comprises a plurality of player indicia and a dealer area. Each of the player indicia are adapted for indicating a position of a player when a dealer deals the cards. The dealer area indicates the cards dealt to the dealer.

Still yet another object of the present invention is to provide a new card game system and method of playing a card game that provides entertainment for a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed: description thereof. Such description makes reference to the annexed drawings wherein.

DESCRIPTION OF THE PREFERRED EMBODIMENT

Figure 1:
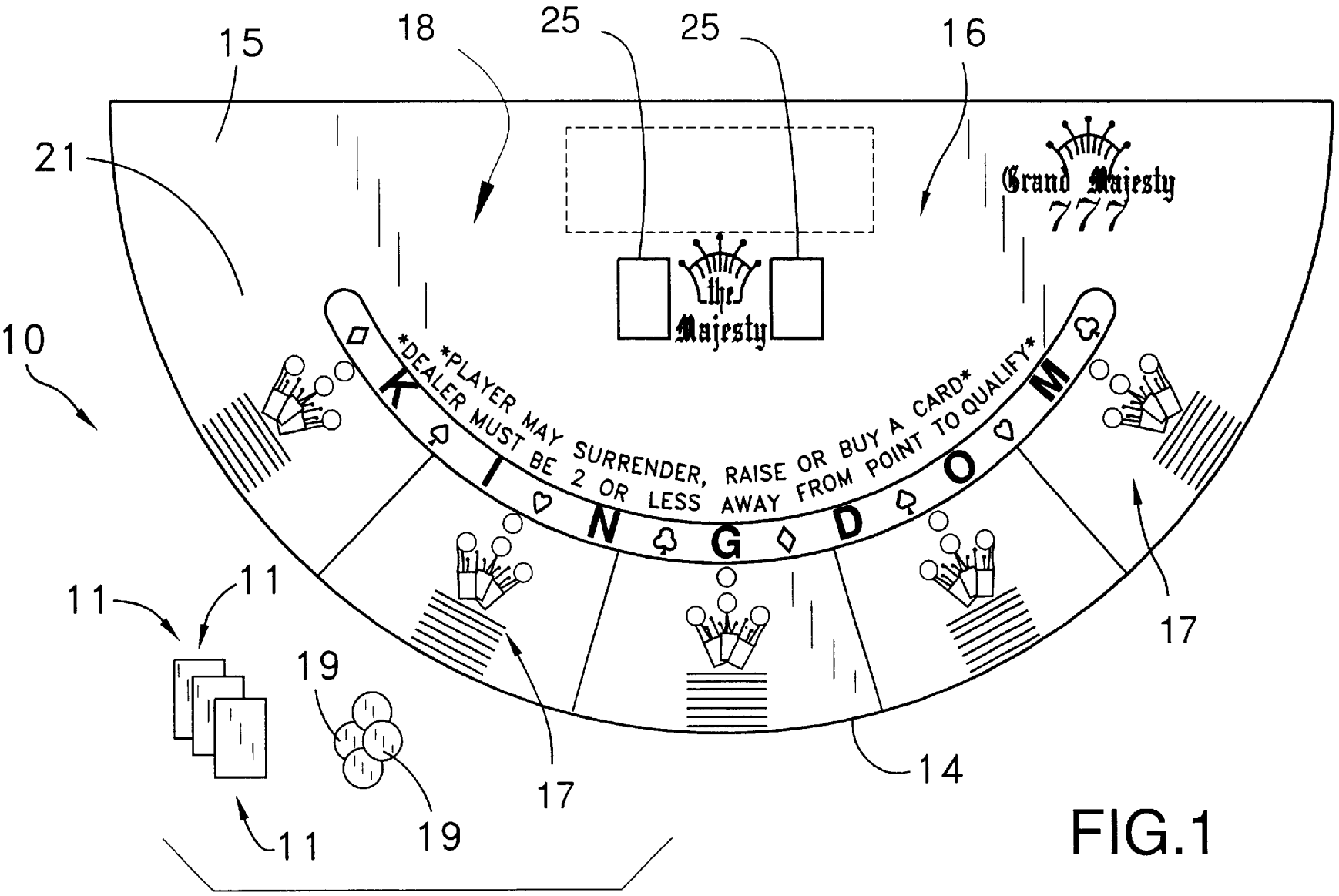
FIG. 1 is a top view of a new card game system according to the present invention.
Figure 2:
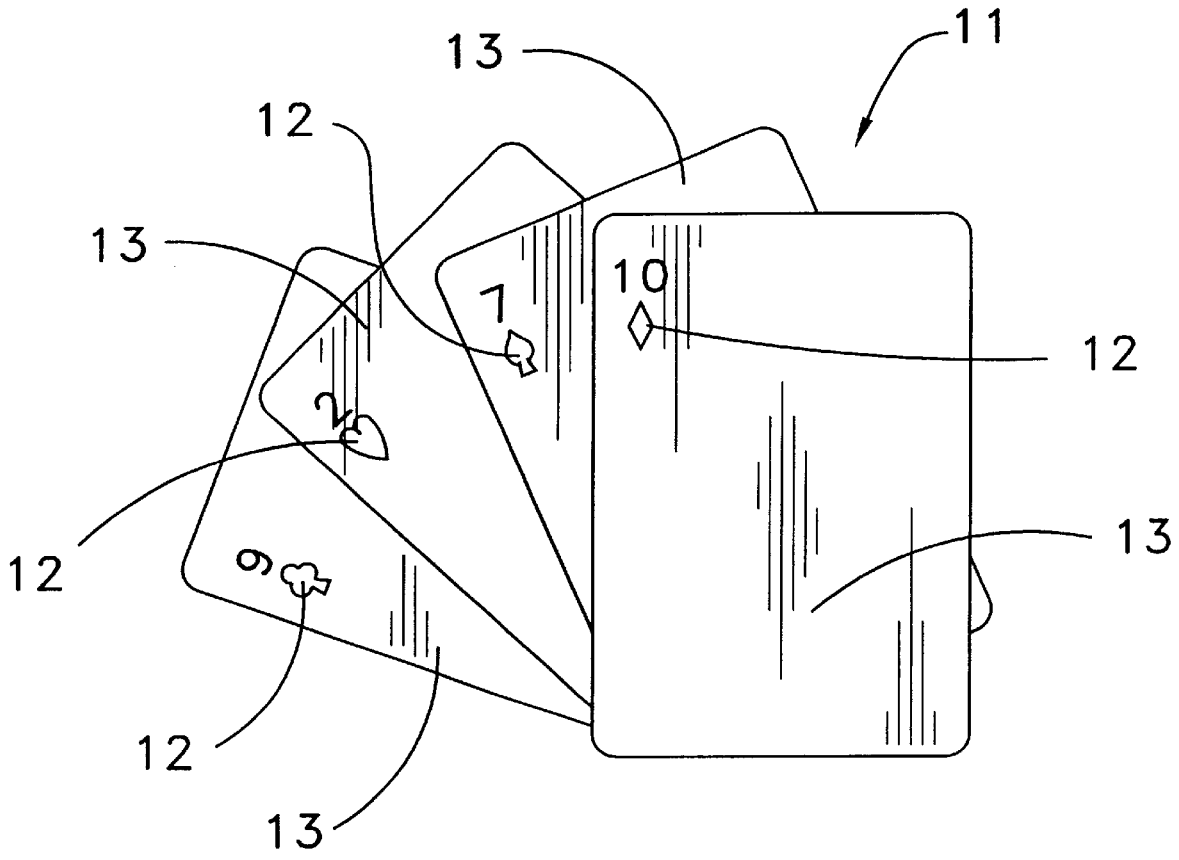
FIG. 2 is an enlarged of view of one of the decks of the present invention.
Figure 3:
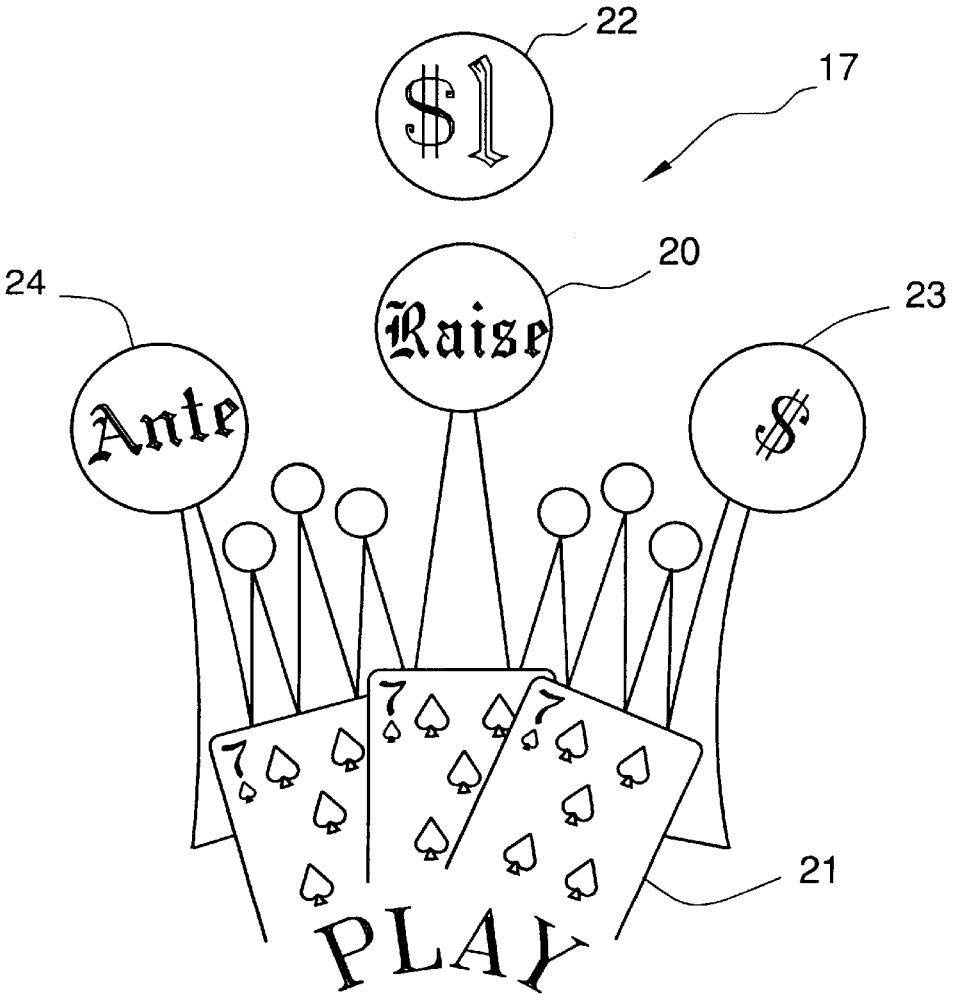
FIG. 3 is an enlarged of view of one of the player indicia of the present invention.

With reference now to the drawings, and in particular to FIGS. 1 and 3 thereof, a new card game system and method of playing a card game embodying the principles and concepts of the present invention and generally designated by the reference numeral 10 will be described.

As best illustrated in FIGS. 1 and 3, the card game system and method of playing a card game 10 generally comprises a plurality of decks 11. Each of the decks 11 comprises a plurality of suits 12. Each of the suits 12 has a plurality of cards 13.

A playing member 14 has an upper surface 15. The playing member 14 has a plurality of playing indicia 16 on the upper surface 15. The playing indicia 16 comprise a plurality of player indicia 17 and a dealer area 18. Each of the player indicia 17 is designed for indicating a position of a player when a dealer deals the cards 13. The dealer area 18 indicates the cards 13 dealt to the dealer.

A portion of the cards 13 of each of the suits 12 has a unique value between 2 and 9. Four of the cards 13 of each of the suits 12 has a value of 10, such as the 10 and all face cards 13. One of the cards 13 of each of the suits 12 has a value of 1, such as the ace. The value of the cards 13 held by the player is added together when the cards 13 are dealt.

Each of a plurality of betting tokens 19 has a monetary value. Each of the betting tokens 19 represents the monetary value being bet by the player.

Each of the player indicia 17 has a betting indicia 20. The betting tokens 19 are placed on the betting indicia 20 of the player indicia 17 for indicating a wager of the player.

Each of the player indicia 17 has a card indicia 21. Each of the cards 13 is placed on the card indicia 21 when the cards 13 are dealt whereby the card indicia 21 indicates that the cards 13 placed on the card indicia 21 are a player cards 13.

Each of the player indicia 17 has a side bet indicia 22. The betting tokens 19 are placed on the side bet indicia 22 of the player indicia 17 for indicating a wager of the player.

Each of the player indicia 17 has a buy indicia 23. The betting tokens 19 are placed on the buy indicia 23 of the player indicia 17 for indicating the player wishes to buy a card.

Each of the player indicia 17 has an ante indicia 24. The betting tokens 19 are placed on the ante indicia 24 of the player indicia 17 for indicating an ante of the player.

The playing indicia 16 of the playing member 14 has a target indicia 25. The cards 13 are placed on the target indicia 25 when the cards 13 are dealt. The target indicia 25 indicating the cards 13 placed on the target indicia 25 are target cards 13.

In use, each of the players places a portion of the betting tokens 19 on the ante indicia 24 of each of the player indicia 17 by the associated player. Each player decides whether to place of portion of the betting tokens 19 on the side bet indicia 22. The dealer deals the cards 13 to each player and the dealer. The dealer usually deals from four decks 11 of cards 13. The cards 13 are placed face down on the card indicia 21 of each of the player indicia 17 of the associated player. The target cards 13 from the cards 13 are dealt onto the target indicia 25 on the upper surface 15 of the playing member 14. The target cards 13 are placed face up on the target indicia 25 whereby the value and the suit of each of the target cards 13 is viewable by each player and the dealer.

The player may then win the game against the dealer depending on the combination of cards 13 held by the player. The player will win if the combination of three cards 13 equals the summed value of the cards 13 dealt to the target indicia 25, comprises three tens, comprises three of a kind, comprises three sevens, comprises three of kind in the same suit or comprises three sevens in the same suit with the odds paid to player increasing from lowest to highest respectively. The player being paid better odds when having three cards 13 equaling the summed value of the cards 13 on the target indicia 25 when the player has put betting tokens 19 on the side bet indicia 22.

If the player did not win the hand dealt the player compares of the cards 13 dealt to the player to the target cards 13 whereby each player uses a plurality of the cards 13 dealt to the player to be closest to the value of the target cards 13 when the value of the target cards 13 are summed. At this time each player chooses whether to continue playing.

If the associated player chooses to not continue, the player forfeits at least a portion of the betting tokens 19 placed on the ante indicia 24 of the player indicia 17 of the associated player.

The player at this time has two choices to make. First, the player chooses to continue by placing a portion of the betting tokens 19 on the betting indicia 20 when the player believes that the cards 13 dealt to the associated player is closer to the summed value of the cards 13 of the target indicia 25 than the cards 13 dealt to the dealer. Second, the player may choose to continue by placing a portion of the betting tokens 19 on the buy indicia 23. The player then selects one of the cards 13 dealt to the associated player to be replaced with a replacement card dealt to the associated player by the dealer.

The combination of cards 13 dealt to the player are then placed turned face up on the upper surface 15 of the playing member 14 by the associated player. The cards 13 dealt to the dealer are turned face up.

The player wins the game when the cards 13 dealt to each player are compared to the cards 13 of the dealer and the value of the cards 13 dealt to the associated player is closer to the summed value of the target indicia 25 than the value of the cards 13 dealt to the dealer.

The dealer pays to the associated player an amount equal to the amount of the betting tokens 19 placed on the ante indicia 24 and returns the portion of the betting tokens 19 placed on the betting indicia 20 to the associated player when the difference between summed, value of the cards 13 dealt to the dealer and the summed value of the cards 13 dealt to the target indicia 25 is 2 or less. The dealer pays to the associated player an amount equal to the amount of the betting tokens 19 placed on the ante indicia 24 and an amount equal to the amount of the betting tokens 19 placed on the betting indicia 20 when the difference between the summed value of the cards 13 dealt to the dealer and the summed value of the cards 13 dealt to the target indicia 25 is greater than 2.

The associated player loses the game when the cards 13 dealt to the associated player are compared to the cards 13 of the dealer and the value of the cards 13 dealt to the dealer is closer to the summed value of the target indicia 25 than the value of the cards 13 of the associated player. The dealer collects the portion of the betting tokens 19 placed on the ante indicia 24 and the betting indicia 20.

Each player losing the game when the summed value of the cards 13 dealt to the dealer equals the summed value of the cards 13 dealt to the target indicia 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a card game comprising:

providing a card game system comprising:

a plurality of decks, each of said decks comprising a plurality of suits, each of said suits having a plurality of cards;

a playing member having an upper surface, said playing member having a plurality of playing indicia on said upper surface, said playing indicia comprising a plurality of player indicia and a dealer area, each of said player indicia being adapted for indicating a position of a player when a dealer deals said cards, said dealer area indicating said cards dealt to the dealer;

a portion of said cards of each of said suits having a unique value between 2 and 9, said value of said cards held by the player being added together when said cards are dealt;

wherein four of said cards of each of said suits has a value of 10, said value of said cards held by the player being added together when said cards are dealt;

wherein one of said cards of each,of said suits has a value of 1, said value of said cards held by the player being added together when said cards are dealt;

a plurality of betting tokens each having a monetary value, each of said betting tokens representing said monetary value being bet by the player;

each of said player indicia having a betting indicia, said betting tokens being placed on said betting indicia of said player indicia for indicating a wager of the player;

each of said player indicia having a card indicia, Each of said cards being placed on said card indicia when said cards are dealt such that said card indicia indicates that said cards placed on said card indicia are player cards;

each of said player indicia having a side bet indicia, said betting tokens being placed on said side bet indicia of said player indicia for indicating a wager of the player;

each of said player indicia having a buy indicia, said betting, tokens being placed on said buy indicia of said player indicia for indicating the player wishes to buy a card;

each of said player indicia having an ante indicia, said betting tokens being placed on said ante indicia of said player indicia for indicating an ante of the player;

said playing indicia of said playing member having a target indicia, said cards being placed on said target indicia when said cards are dealt, said target indicia indicating said cards placed on said target indicia are target cards;

placing of a portion of said betting tokens on said ante indicia of each of said player indicia by the associated player;

dealing of cards by the dealer to each player and the dealer, said cards being placed face down on said card indicia of each of said player indicia of the associated player; and dealing of target cards from said cards onto said target indicia on said upper surface of said playing member, said target cards being placed face up on said target indicia such that said value and said suit of each of said target cards is viewable by each player and the dealer.

2. The method of playing the card game as set forth in claim 1, further comprising:

winning of the game by the player when a value of each of said cards dealt to the player are equal such that the dealer pays of odds to the associated player.

3. The method of playing the card game as set forth in claim 2, further comprising:

winning of the game by the player when said suit of each of said cards dealt to the player are the same such that the dealer pays greater odds to the associated player.

4. The method of playing the card game as set forth in claim 3, further comprising:

winning of the game by the player when a value of each of said cards deal to the player equals 7 such that the dealer pays greater odds to the associated player.

5. The method of playing the card game as set forth in claim 4, further comprising:

paying of greater odds by the dealer to the associated player when the associated player places a portion of said betting tokens on said side bet indicia before said cards being dealt.

6. The method of playing the card game as set forth in claim 2, further comprising:

winning of the game by the player when a value of each of said cards dealt to the player equals 7 such that the dealer pays greater odds to the associated player.

7. The method of playing the card game as set forth in claim 6, further comprising:

paying of greater odds by the dealer to the associated player when the associated player places a portion of said betting tokens on said side bet indicia before said cards being dealt.

8. The method of playing the card game as set forth in claim 1, further comprising:

winning of the game by the player when a sum of said cards dealt to the player is equal to the sum of the value of said target cards such that the dealer pays odds to the associated player.

9. The method of playing the card game as set forth in claim 8, further comprising:

paying of greater odds by the dealer to the associated player when the associated player places a portion of said betting tokens on said side bet indicia before said cards being dealt.

10. The method of playing the card game as set forth in claim 1, further comprising:

comparing of said cards dealt to each player by the respective player to said target cards such that each player uses a plurality of said cards dealt to the player to be closest to said value of said target cards when said value of said target cards are summed, each player choosing whether to continue playing.

11. The method of playing the card game as set forth in claim 10, further comprising:

choosing of the player to continue by placing a portion of said betting tokens on said betting indicia when the player believes that said cards dealt to the associated player is closer to the summed value of said cards of said target indicia than said cards dealt to the dealer.

12. The method of playing the card game as set forth in claim 11, further comprising:

placing a combination of said cards dealt to the player in turn face up on said upper surface of said playing member, said cards dealt to the dealer being turned face up; and winning of the game when said cards dealt to each player are compared to said cards of the dealer such that said value of said cards dealt to the associated player is closer to the summed value of said target indicia than said value of said cards of the dealer.

13. The method of playing the card game as set forth in claim 10, further comprising:

paying of an amount equal to the amount of said betting tokens placed on said ante indicia and returning of the portion of said betting tokens placed on said betting indicia to the associated player when the summed value of said cards dealt to the dealer is within 2 of the summed value of said cards dealt to said target indicia.

14. The method of playing the card game as set forth in claim 12, further comprising:

paying of an amount equal to the amount of said betting tokens placed on said ante indicia and an amount equal to the amount of said betting tokens placed on said betting indicia to the associated player when the difference between the summed value of said cards dealt to the dealer and the summed value of said cards dealt to said target indicia is greater than 2.

15. The method of playing the card game as set forth in claim 11, further comprising:

placing a combination of said cards dealt to the player in turn face up on said upper surface of said playing member, said cards dealt to the dealer being turned face up; and losing of the game by the associated player when said cards dealt to each player are compared to said cards of the dealer such that said value of said cards dealt to the dealer is closer to the summed value of said target indicia than said value of said cards of the associated player, collecting of the portion of said betting tokens placed on said ante indicia and said betting indicia by the dealer.

16. The method of playing the card game as set forth in claim 10, further comprising:

choosing of the player to continue, placing a portion of said betting tokens on said buy indicia, replacing of one of said cards dealt to the player and not used in said combination of said cards with a replacement card dealt to the associated player by the dealer.

17. The method of playing the card game as set forth in claim 16, further comprising:

choosing of the player to continue by placing a portion of said betting tokens on said betting indicia when the player believes that said cards dealt to the associated player is closer to the summed value of said cards of said target indicia than said cards dealt to the dealer.

18. The method of playing the card game as set forth in claim 17, further comprising:

placing a combination of said cards dealt to the player in turn face up on said upper surface of said playing member, said cards dealt to the dealer being turned face up; and winning of the game when said cards dealt to each player are compared to said cards of the dealer such that said value of said cards dealt to the associated player is closer to the summed value of said target indicia than said value of said cards of the dealer.

19. The method of playing the card game as set forth in claim 18, further comprising:

paying of an amount equal to the amount of said betting tokens placed on said ante indicia and returning of the portion of said betting tokens placed on said betting indicia to the associated player when the summed value of said cards dealt to the dealer is within 2 of the summed value of said cards dealt to said target indicia.

20. The method of playing the card game as set forth in claim 18, further comprising:

paying of an amount equal to the amount of said betting tokens placed on said ante indicia and an amount equal to the amount of said betting tokens placed on said betting indicia to the associated player when the difference between the summed value of said cards dealt to the dealer and the summed value of said cards dealt to said target indicia is greater than 2.

21. The method of playing the card game as set forth in claim 17, further comprising:

placing a combination of said cards dealt to the player in turn face up on said upper surface of said playing member, said cards dealt to the dealer being turned face up; and losing of the game by the associated player when said cards dealt to each player are compared to said cards of the dealer such that said value of said cards dealt to the dealer is closer to the summed value of said target indicia than said value of said cards of the associated player, collecting of the portion of said betting tokens placed on said ante indicia and said betting indicia by the dealer.

22. The method of playing the card game as set forth in claim 10, further comprising:

choosing of the player to not continue, said player forfeiting at least a portion of said betting tokens placed on said ante indicia of said player indicia of the associated player.

23. The method of playing the card game as set forth in claim 10, further comprising:

losing of the game by each player when the summed value of said cards dealt to the dealer equals the summed value of said cards dealt to said target indicia.

* * * * *